US005515623A

United States Patent [19]

Weeks

[11] Patent Number: 5,515,623

[45] Date of Patent: May 14, 1996

[54] SNOWPLOW WITH DEICER SPRAY ATTACHMENT

[75] Inventor: W. Dan Weeks, Kalamazoo, Mich.

[73] Assignee: Root Spring Scraper Co., Kalamazoo, Mich.

[21] Appl. No.: 282,987

[22] Filed: Jul. 29, 1994

[51] Int. Cl.[6] ..... E01H 5/10

[52] U.S. Cl. ..... 37/227; 37/202; 239/159; 239/289

[58] Field of Search ..... 37/157, 227, 266, 37/199, 200, 202, 241, 267; 172/125, 701.1, 747; 239/159, 289

[56] References Cited

U.S. PATENT DOCUMENTS

| | | | |
|---|---|---|---|
| 1,204,772 | 11/1916 | Hornecker | 239/159 X |
| 1,508,502 | 9/1924 | Brisson . | |
| 1,629,160 | 5/1927 | Heermance . | |
| 2,259,120 | 10/1941 | Sweeney | 37/227 |
| 2,936,537 | 5/1960 | Bain | 37/202 X |
| 3,456,368 | 7/1969 | Jacques | 37/227 |
| 3,746,368 | 7/1973 | Gledhill et al. | 280/481 |
| 4,271,617 | 6/1981 | Yoshizawa | 37/197 |
| 4,571,861 | 2/1986 | Klever et al. | 37/241 |
| 5,199,196 | 4/1993 | Straley | 37/442 |

FOREIGN PATENT DOCUMENTS 1418391 8/1988 U.S.S.R. .

OTHER PUBLICATIONS

The Batts 4000 Gallon De-Icer Flusher (1 page).
The Batts 2000 Gallon De-Icer (1 page).
Batts De-Icer Pro Options (1 page).

*Primary Examiner*—Terry Lee Melius
*Assistant Examiner*—Robert Pezzuto
*Attorney, Agent, or Firm*—Flynn, Thiel, Boutell & Tanis

[57] ABSTRACT

A road and/or airport runway scraping blade for use with a ground supported vehicle, which scraping blade includes a frame for attaching the scraping blade to the vehicle. The scraping blade has a front facing side, a rearward facing side, a top edge and a bottom edge, both edges extending laterally of a longitudinal axis of the vehicle when coupled to the vehicle. Coupling structure is provided for facilitating a coupling of the frame to the vehicle with the rearward facing side facing the rear of the vehicle. An elongated conduit and a fastening structure is provided for fastening the conduit to the rearward facing side of the blade intermediate the coupling structure and the bottom edge of the blade. A longitudinal axis of the conduit extends generally parallel to the lower edge. A plurality of laterally spaced spray nozzles are provided and are oriented along a length of the conduit and communicating with an interior of the conduit. The spray nozzles are directed downwardly away from the coupling structure and toward the ground so that a liquid supplied to the interior of the conduit will be sprayed onto the ground in a region immediately behind the lower edge.

11 Claims, 4 Drawing Sheets

SNOWPLOW WITH DEICER SPRAY ATTACHMENT

FIELD OF THE INVENTION

This invention relates to a road and/or airport runway scraping blade for use with a ground supported vehicle and, more particularly, to a road and/or airport runway scraping blade having liquid dispensing structure oriented on a side of the blade facing the vehicle.

BACKGROUND OF THE INVENTION

Snow and ice removal from roadways and airport runways is deemed to be a necessity in order to enable people to safely travel on the roadways and runways. Scraping blades are usually utilized for this purpose. The scraping blades are mounted on to the front of the vehicle or the underside thereof intermediate the wheels. Oftentimes, mere use of the scraping blade is not enough in that a layer of packed snow and/or ice remains on the roadway and airport runway. As a result, and on roadways, sand or other particulate, such as particulate salt, are spread onto the roadway in order to effect a melting of the packed snow and/or ice to enable the slush that is created to be removed from the roadway by road scraping equipment. However, and over the years, salt has been found to be harmful to the environment and, particularly, harmful to the infra-structure, namely, bridge constructions and the like by reason of the fact that salt destroys the supporting structure of the bridges.

At airports, removal of snow and/or ice from the airport runways is deemed essential in order to enable the aircraft to be safely controlled while on the ground. Airports have traditionally used scraping blades that are approximately 20 feet wide to effect snow removal from the runways. In addition, runway maintenance has not been able to incorporate the use of particulate substances to enhance traction and/or enhance snow melting because of the possibility that the particulate will be ingested into the aircraft engines effecting a destruction thereof. Thus, runway maintenance has incorporated the use of a liquid deicer solution which is sprayed onto the runways well after the snow has been removed therefrom. For example, and at small airports, a runway supervisor will, after a snowy night, first initiate snow removal via a first vehicle and before the first plane is to land or takeoff. A second vehicle, usually a tank truck loaded with a liquid deicer solution, will move up and down the runway spraying the liquid deicer onto the runway to convert any snow and/or ice thereon to a liquid. On a sunny day, the sun will usually dry the runway. The liquid deicer will create a slush, if it is snowing, which slush is movable by the scraper blade. Ice is not movable. Thus, the procedure for rendering a runway usable normally involves a first vehicle equipped with scraping equipment to move along the runway to effect snow removal and shortly thereafter, a second vehicle in the form of a tank truck equipped with spraying equipment moves along the same runway spraying liquid deicer onto the runway to effect a conversion of any remaining snow and/or ice into a liquid. The use of multiple vehicles in order to accomplish this task is obviously expensive.

Accordingly, it is an object of this invention to provide a scraping blade for use with a vehicle having a liquid dispensing structure oriented on the side of the blade facing the rear of the vehicle when the blade is mounted on the vehicle.

It is a further object of the invention to provide a scraping blade, as aforesaid, wherein the liquid dispensing structure is oriented beneath the structure that facilitates a connection of the road scraping blade to the vehicle so that no liquid dispensed from the liquid dispensing structure will spray onto the coupling structure.

It is a further object of the invention to provide a scraping blade, as aforesaid, wherein the vehicle on which the scraping blade is mounted has a liquid storage tank thereon and from which liquid is delivered to the liquid dispensing structure.

It is a further object of the invention to provide a scraping blade, as aforesaid, which is durable, easily maintained and utilizes standard structure for facilitating a connection of the blade to the vehicle.

SUMMARY OF THE INVENTION

The objects and purposes of the invention have been met by providing a road and/or runway scraping blade for use with a ground supported vehicle, which scraping blade includes a frame for attaching the scraping blade to the vehicle. The scraping blade has a front facing side, a rearward facing side, a top edge and a bottom edge, both edges extending laterally of a longitudinal axis of the vehicle when coupled to the vehicle. Coupling structure is provided for facilitating a coupling of the frame to the vehicle with the rearward facing side facing the rear of the vehicle. An elongated conduit and a fastening structure is provided for fastening the conduit to the rearward facing side of the blade intermediate the coupling structure and the bottom edge of the blade. A longitudinal axis of the conduit extends generally parallel to the lower edge. A plurality of laterally spaced spray nozzles are provided and are oriented along a length of the conduit and communicating with an interior of the conduit. The spray nozzles are directed downwardly away from the coupling structure and toward the ground so that a liquid supplied to the interior of the conduit will be sprayed onto the ground in a region immediately behind the lower edge.

BRIEF DESCRIPTION OF THE DRAWINGS

Other objects and purposes of this invention will be apparent based upon a reading of the following specification with reference being made to the drawings, in which.

DETAILED DESCRIPTION

Figure 1:
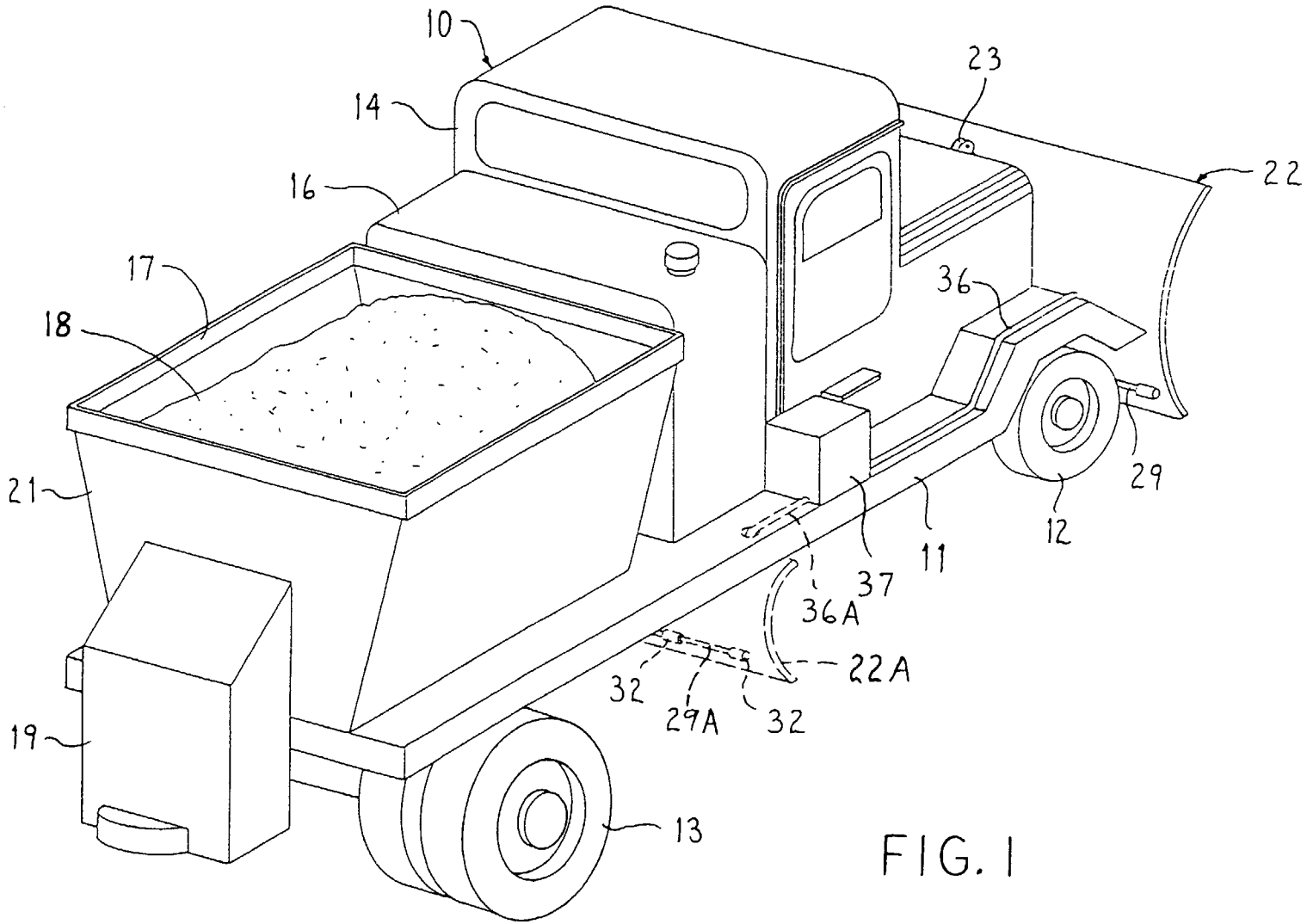
FIG. 1 is an isometric view of a vehicle having a road and/or airport runway scraping blade mounted thereon, which scraping blade has liquid dispensing structure thereon and the vehicle has a liquid storage tank oriented between the cab and the sander.

FIG. 1 illustrates a vehicle 10 having a frame 11 and ground engaging supporting wheels 12 and 13 therefor. A cab 14 is provided at the front of the frame 11 and is adapted to house the vehicle driver in a conventional manner. Rearwardly of the cab 14 there is provided a liquid storage tank 16 and a container 17 adapted to hold a particulate substance, such as particulate salt and/or sand 18. A conventional particulate distributing mechanism 19 is provided on the rearwardly facing side 21 of the container 17, which particulate distributing mechanism 19 is capable of removing particulate 18 from the container 17 and distributing it onto the roadway.

Figure 2:
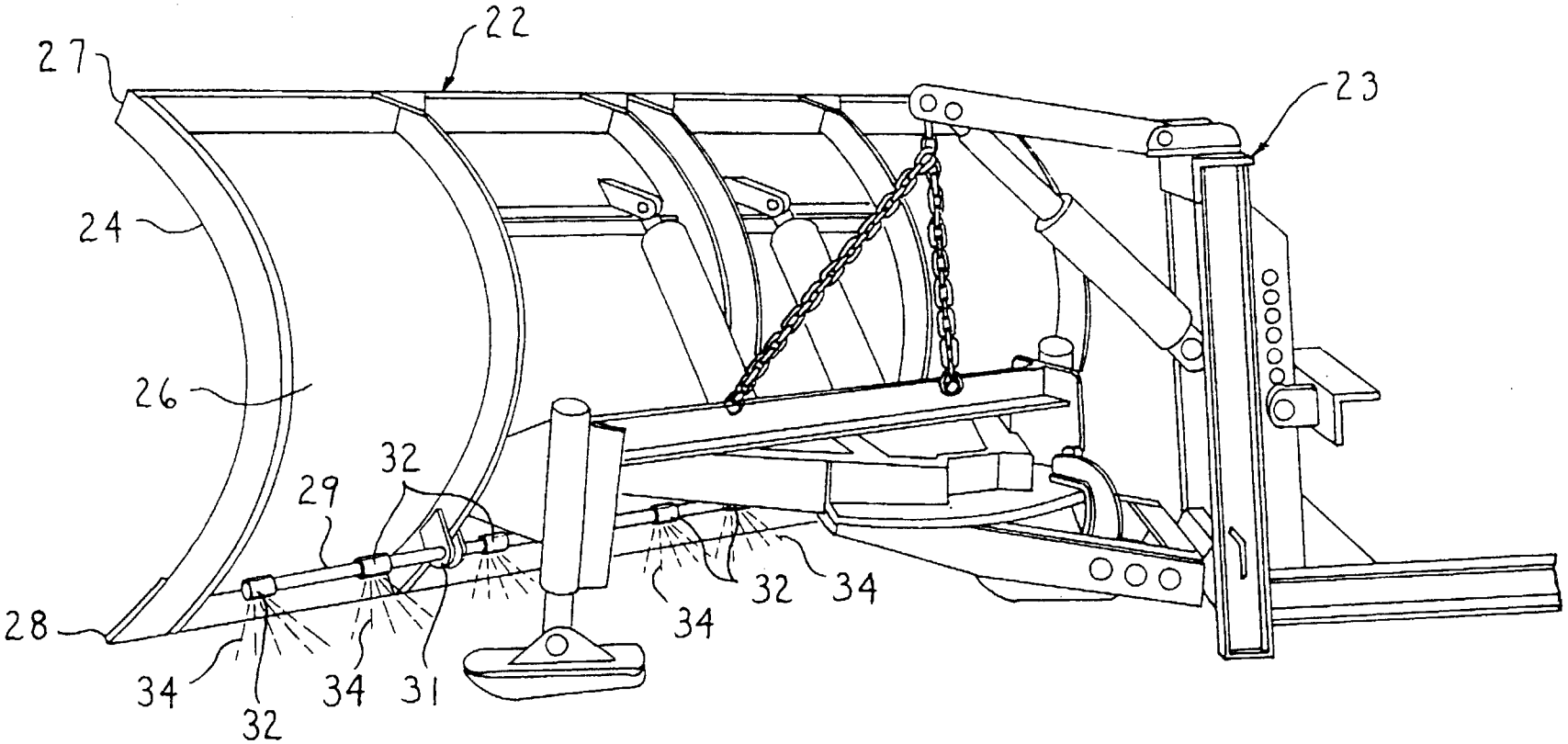
FIG. 2 is an isometric view illustrating the support structure for a scraping blade mounted on the front end of a vehicle.
Figure 3:
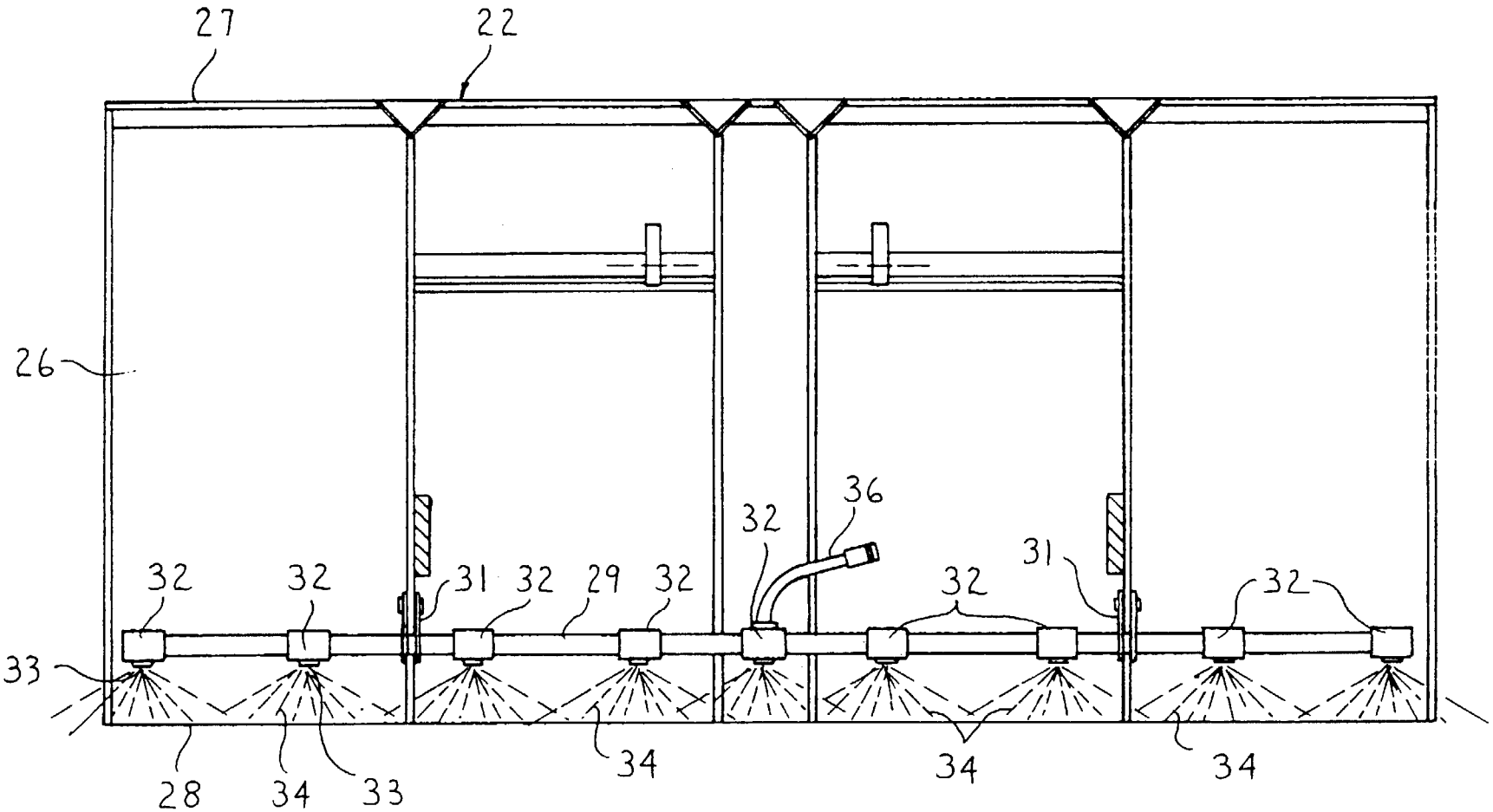
FIG. 3 is a rear view of the scraping blade illustrated in FIG. 2.

The vehicle 10 also has a conventional road and/or airport runway scraping blade 22 mounted to the front end thereof. Further details of the scraping blade 22 are illustrated in FIGS. 2 and 3. For example, a conventional coupling mechanism 23 is provided for effecting a coupling of the scraping blade to the vehicle. In fact, the coupling mechanism shown in the drawings has been taken from U.S. Pat. No. 3,746,368 and reference thereto is to be incorporated herein. Further discussion in regard to the coupling mechanism 23 is deemed unnecessary.

The scraping blade 22 has a front facing side 24, a rear facing side 26, a top edge 27 and a bottom edge 28. The aforesaid structure extends laterally of a longitudinal axis of the vehicle 10 when coupled to the vehicle by the coupling mechanism 23.

An elongated conduit 29 is provided along the rear facing side 26 of the scraping blade 22 just slightly above the bottom edge 28. The conduit 29 is secured to selected ones of the rearwardly projecting ribs 30 on the side 26 by a plurality of fastening devices 31. A longitudinal axis of the conduit 29 extends generally parallel to the lower edge 28. A plurality of spray nozzles 32 are provided along the length of the conduit 29 and communicate with the interior of the conduit 29. The spray nozzles 32 each include a nozzle 33 oriented to direct a spray pattern 34 downwardly toward the ground and away from the structure of the coupling mechanism 23.

Liquid is supplied to the conduit 29 through a conduit 36 and a liquid control mechanism 37, which liquid control mechanism 37 can be a conventional fluid valve as well as a pump in combination therewith adapted to remove liquid from the storage container 16 and delivering it under pressure to the conduits 36 and 29 so that the liquid will be sprayed out of the nozzles 33 and onto the ground in the aforementioned spray patterns 34 across the entire width of the scraping blade as illustrated in FIGS. 2 and 3.

Figure 4:
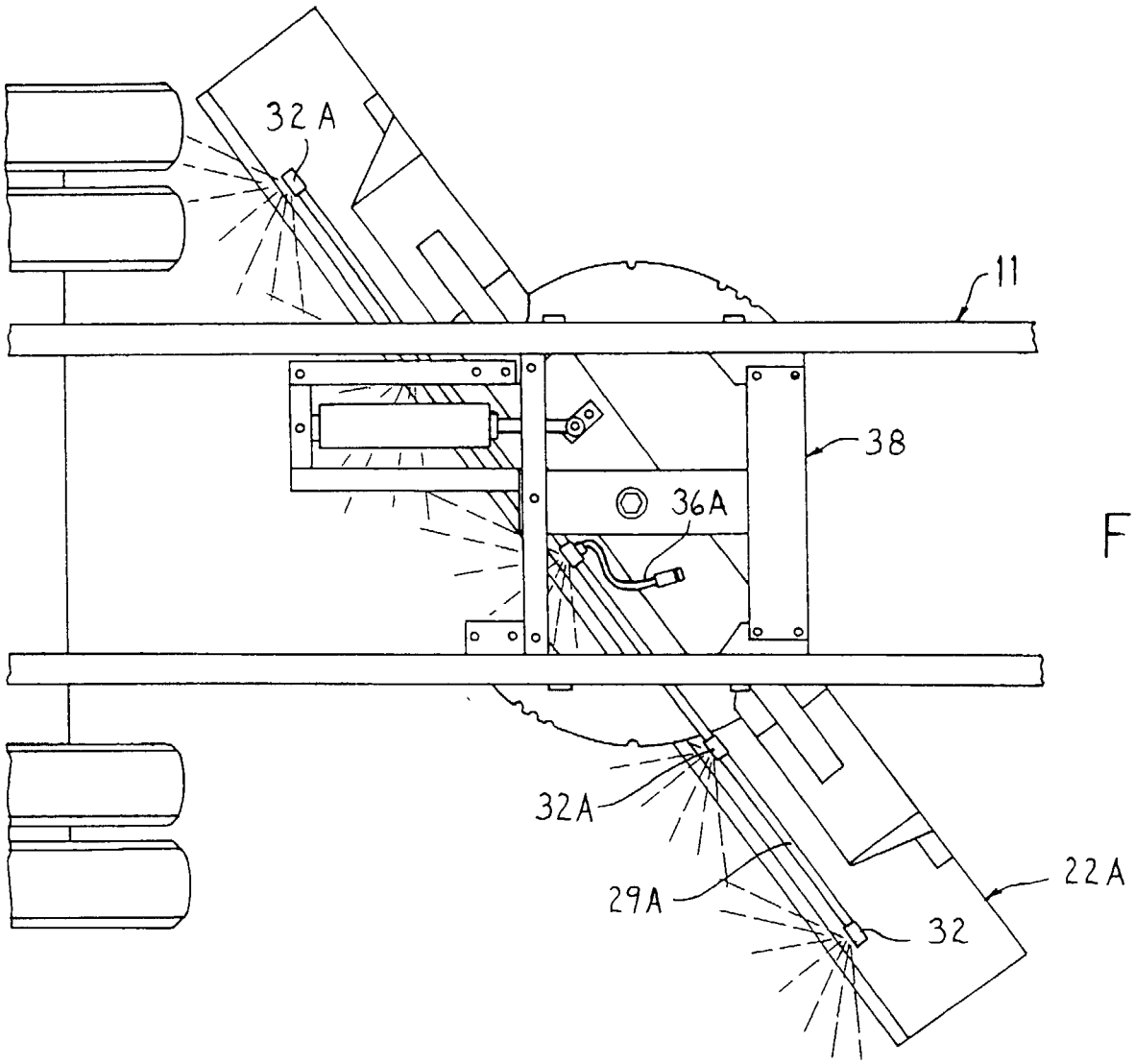
FIG. 4 is a top view of a scraping blade adapted to be mounted under the body of a vehicle intermediate the supporting wheels therefor.

As is illustrated in broken lines in FIG. 1, an alternate scraping blade 22A can be mounted under the body of the vehicle 10 intermediate the supporting wheels 12 and 13. The rear facing side of the alternate blade 22A has a laterally extending conduit 29A equipped with a plurality of spray nozzles 32A adapted to direct a spray 34A downwardly toward the ground and away from the supporting structure 38 supporting the scraping blade 22A on the underside of the vehicle 10. FIG. 4 is a top view of the supporting mechanism 38 supporting the scraping blade 22A on the underside of the vehicle frame 11. The supporting construction 38 is conventional and further discussion in regard to it is deemed unnecessary. Liquid is supplied to the conduit 29A through a conduit 36A. Liquid being supplied to the conduit 29A is controlled by the liquid control mechanism 37 as previously described.

In use, the liquid storage tank 16 is preferably filled with any one of a variety of liquid deicers, such as a liquid potassium acetate. It is well recognized that potassium acetate offers low corrosion characteristics. Further, potassium acetate is an excellent deicer liquid because it is also a fertilizer. Other liquid deicers can be used, such as magnesium chloride. Calcium chloride can be used because it is more effective at lower temperatures than salt (it can be used to −20° F.) and, like magnesium chloride, attracts moisture from the air which hastens its dissolving and melting.

As the vehicle moves along the roadway or runway with the lower edge 28 of the scraping blade 22 engaging the roadway or runway, snow and/or ice is removed from the roadway or runway. Generally, and on a roadway, the particulate 18 is distributed by the distributor mechanism 19 onto the roadway so as to enhance melting and traction by the traffic following the vehicle 10. When the vehicle 10 approaches a bridge, the corrosive form of the particulate 18, such as salt, is no longer dispensed from the dispenser 19. Instead, the liquid control mechanism 37 is activated to cause liquid deicer in the storage tank 16 to be delivered to the conduit 29 to cause a liquid spray to spray down onto the roadway as the vehicle approaches the bridge and passes over the bridge. Following a traverse of the bridge, the liquid control mechanism 37 is deactivated to halt the flow of liquid deicer to the conduit 29 and, subsequently, the particulate dispensing mechanism 19 is reactivated to continue to dispense particulate onto the roadway as the vehicle continues on down the roadway. As a result, the use of the low corrosion liquid deicer on the bridge prevents the corrosive materials from attacking the infrastructure of the bridge. Use at an airport to spray runways as described above is also possible. Thus, and with one vehicle and one vehicle operator, snow can be removed from the roadway, particulate spread onto the roadway as well as spraying of a liquid deicer onto the roadway and/or bridge structures. At airports, one vehicle operator can plow snow and effect a dispensing of liquid deicer from the same vehicle.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a snow removal scraping blade assembly for use with a ground supported vehicle in removing snow along a path of movement of the vehicle, said scraping blade assembly having a frame supporting a scraping blade thereon, said scraping blade having a front facing side, a rearward facing side, a top edge and a bottom edge both extending laterally of a longitudinal axis of the vehicle when coupled to the vehicle, and coupling means for facilitating a coupling of said frame to the vehicle with the rearward facing side facing the rear of the vehicle, the improvement comprising:

an elongated conduit and fastening means for fastening said conduit to said rearward facing side of said scraping blade intermediate said coupling means and said bottom edge, a longitudinal axis of said conduit extending generally parallel to said bottom edge, an interior of said conduit being connected in fluid circuit with a liquid containing reservoir; and a plurality of laterally spaced liquid spray nozzles oriented along a length of said conduit and communicating with the interior of said conduit, said liquid spray nozzles being directed toward the ground so that a liquid supplied to the interior of said conduit will be sprayed directly onto the ground cleared of snow in a region immediately behind said bottom edge and laterally of the longitudinal axis of the vehicle.

2. The snow removal scraping blade according to claim 1, wherein said liquid containing reservoir is mounted on said vehicle.

3. The snow removal scraping blade according to claim 1, wherein intermediate said liquid containing reservoir and said spray nozzles there is provided a liquid pump for pumping under pressure the liquid in said reservoir to said nozzles.

4. The snow removal scraping blade according to claim 1, wherein said coupling means includes means adapted to mount said scraping blade on a front end of the vehicle.

5. The snow removal scraping blade according to claim 1, wherein said coupling means includes means adapted to mount said scraping blade under a body of the vehicle intermediate front and rear wheels thereof.

6. The snow removal scraping blade according to claim 1, wherein the liquid is a deicer.

7. The combination of a ground supported vehicle and a snow removal scraping assembly blade mounted on said vehicle for use in removing snow along a path of movement of the vehicle, comprising:

means on said vehicle for holding and distributing a particulate substance onto the ground on which the vehicle is traveling;

a liquid containing reservoir mounted on said vehicle;

said snow removal scraping blade assembly including a frame supporting a scraping blade thereon, said scraping blade having a front facing side, a rearward facing side, a top edge and a bottom edge both extending laterally of a longitudinal axis of the vehicle when coupled to the vehicle;

coupling means for facilitating a coupling of said frame to the vehicle with the rearward facing side facing the rear of the vehicle;

an elongated conduit and fastening means for fastening said conduit to said rearward facing side of said scraping blade intermediate said coupling means and said bottom edge, a longitudinal axis of said conduit extending generally parallel to said bottom edge; and a plurality of laterally spaced liquid spray nozzles oriented along a length of said conduit and communicating with an interior of said conduit, said spray nozzles being directed downwardly toward the ground so that a liquid supplied to the interior of said conduit will be sprayed directly onto the ground cleared of snow in a region immediately behind said bottom edge and laterally of the longitudinal axis of the vehicle.

8. The road and/or airport runway scraping blade according to claim 7, wherein intermediate said liquid containing reservoir and said spray nozzles there is provided a liquid pump for pumping under pressure the liquid in said reservoir to said nozzles.

9. The road and/or airport runway scraping blade according to claim 7, wherein said coupling means includes means adapted to mount said scraping blade on a front end of the vehicle.

10. The road and/or airport runway scraping blade according to claim 7, wherein said coupling means includes means adapted to mount said scraping blade under a body of the vehicle intermediate front and rear wheels thereof.

11. The snow removal scraping blade according to claim 7, wherein the liquid is a deicer.

* * * * *